United States Patent [19]

Fetter

[11] 4,309,637

[45] Jan. 5, 1982

[54] ROTATING ANODE X-RAY TUBE

[75] Inventor: Richard W. Fetter, Warrenville, Ill.

[73] Assignee: EMI Limited, Hayes, England

[21] Appl. No.: 93,238

[22] Filed: Nov. 13, 1979

[51] Int. Cl.[3] ..... H01J 35/04

[52] U.S. Cl. ..... 313/60; 313/57; 313/32; 313/40; 313/106

[58] Field of Search ..... 313/60, 55, 57, 106, 313/32, 40

[56] References Cited

U.S. PATENT DOCUMENTS

| | | | |
|---|---|---|---|
| 3,546,511 | 12/1970 | Shimula | 313/32 |
| 3,942,015 | 3/1976 | Huxley | 313/60 X |
| 4,024,424 | 5/1977 | Eggelsmann et al. | 313/60 |
| 4,081,707 | 3/1978 | Hartl et al. | 313/60 |

*Primary Examiner*—Stanley T. Krawczewicz

*Attorney, Agent, or Firm*—Cooper, Dunham, Clark, Griffin & Moran

[57] ABSTRACT

In rotating anode X-ray tubes it has not been the practice to provide anode cooling because of problems in arranging coolant flow. A further problem which has arisen, particularly in tubes for computerized tomography which should have precisely defined focal spots, is off-focus radiation apparently resulting from back scattered electrons hitting the tube target away from the focal spot. It is here proposed to provide a rotating anode X-ray tube with a shroud surrounding and close to at least part of the anode. This is extended towards the electron gun with an aperture through which the electron beam travels and an X-ray emissive window. The shroud collects back scattered electrons and can also be fluid cooled. The window provides some collimation and the edges can be shaped to restrict the focal spot as viewed away from the main X-ray beam.

20 Claims, 9 Drawing Figures

ROTATING ANODE X-RAY TUBE

The present invention relates to rotating anode x-ray tubes. A vacuum tube for the generation of x-rays comprises an electron gun producing a high energy beam of electrons and an anode on which the beam is incident. In the region of incidence of the electrons x-rays are produced and these emerge from a suitable x-ray transmissive window. A considerable quantity of heat is generated at the anode when such tubes are in operation and, in a fixed anode X-ray tube, the anode is generally provided with a through flow of cooling fluid such as oil to remove much of the heat. Nevertheless such fixed anode x-ray tubes generate considerable heat at the fixed focal spot and this commonly imposes limits on the energy output of the tube or the time for which it may be continuously operated.

A well known solution to this problem has been found in the rotating anode x-ray tube. The anode is usually provided in the form of a disc which can be rotated about its axis when the tube is operating and the electron beam is incident on the disc away from the centre so that the region of incidence moves over the the anode surface. This prevents heat building up at any single point of the anode, thus allowing higher energies or longer operating times, but it has not proved possible to apply oil cooling directly to such anodes and cooling is usually restricted to heat radiation.

In practice this type of x-ray tube provides many problems including that of providing suitable anode cooling and also inadequate bearing life, collimation of the x-rays and problems in manufacture. A further problem is that of off-focus radiation, that is x-radiation which originates at other points on the anode than the focal spot at which the electron beam is incident.

The production of off-focus radiation makes the origin of the x-rays ill defined so that a well defined x-ray beam originating at the focal spot is surrounded by a lower intensity halo originating around the focal spot. This may not be excessively serious in some applications but modern x-ray apparatus, for example computerised tomographic (CT) apparatus, preferably has a well defined x-ray origin and for such apparatus off-focus radiation can be a considerable problem.

It is an object of this invention to provide a rotary anode x-ray tube by which at least a part of these problems is reduced.

It is another object of this invention to provide: A rotating anode x-ray tube including an anode adapted for rotation about an axis therethrough, an electron gun arranged to direct a beam of electrons to be incident on the surface of the anode to generate x-rays therefrom and a shroud member, fixed relative to said electron gun, arranged to enclose said electron beam in the region of its incidence on the anode, without impeding rotation of said anode, said shroud member including an x-ray transmissive window.

In order that the invention may be clearly understood and readily be carried into effect it will now be described by way of example with reference to the accompanying drawings, of which:

Figure 3:
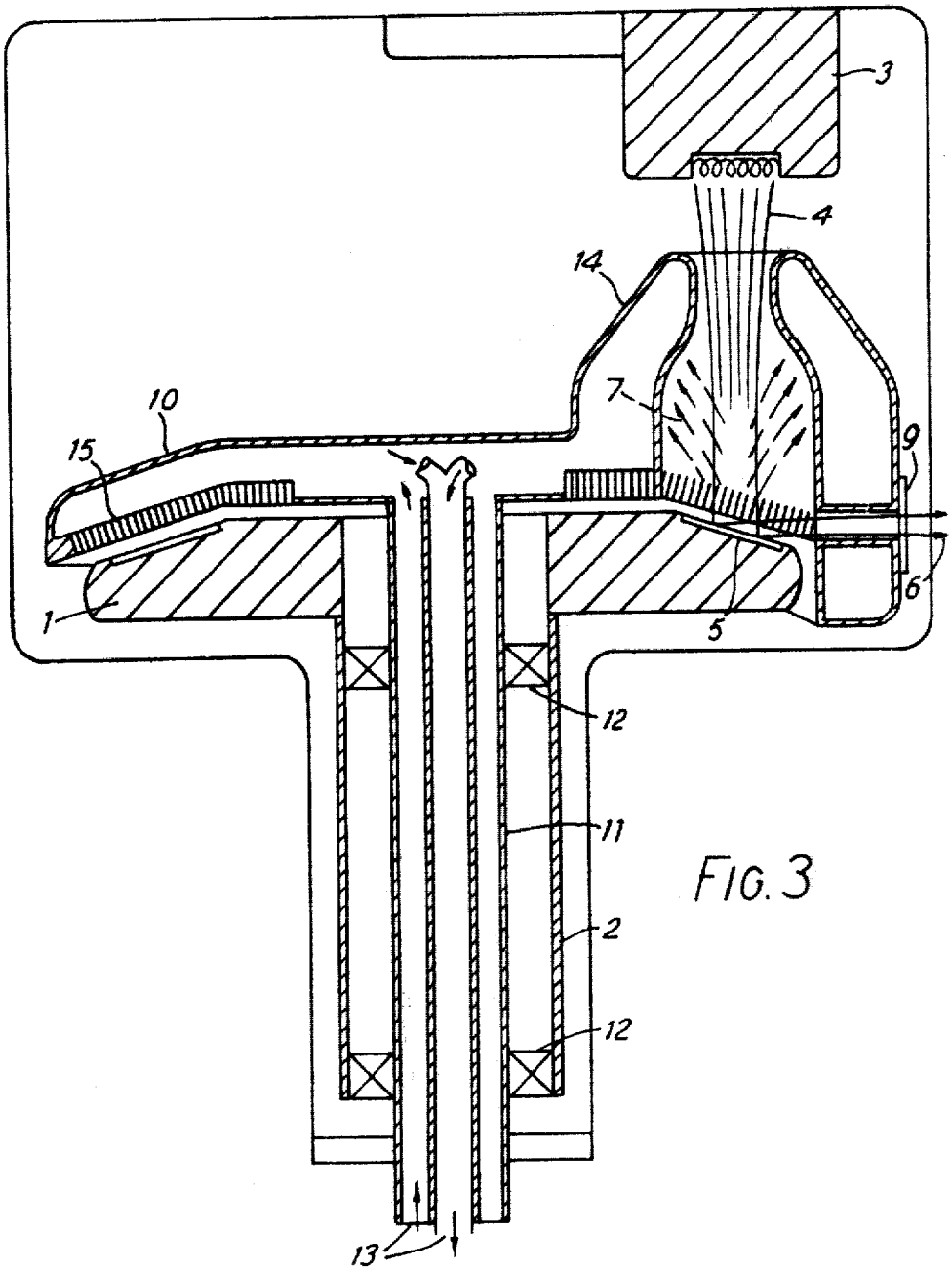
Figure 4:
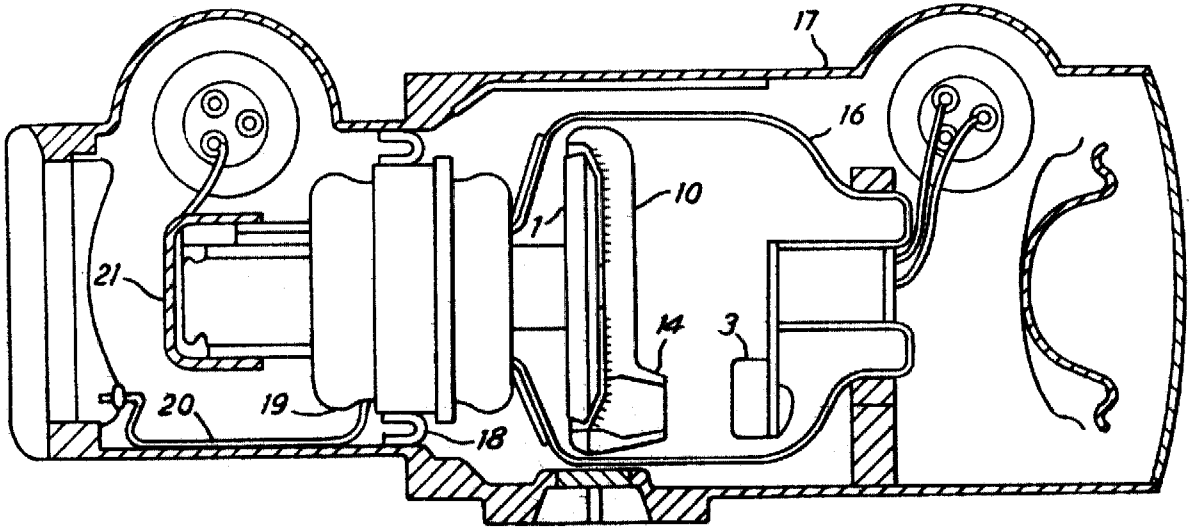
Figure 5:
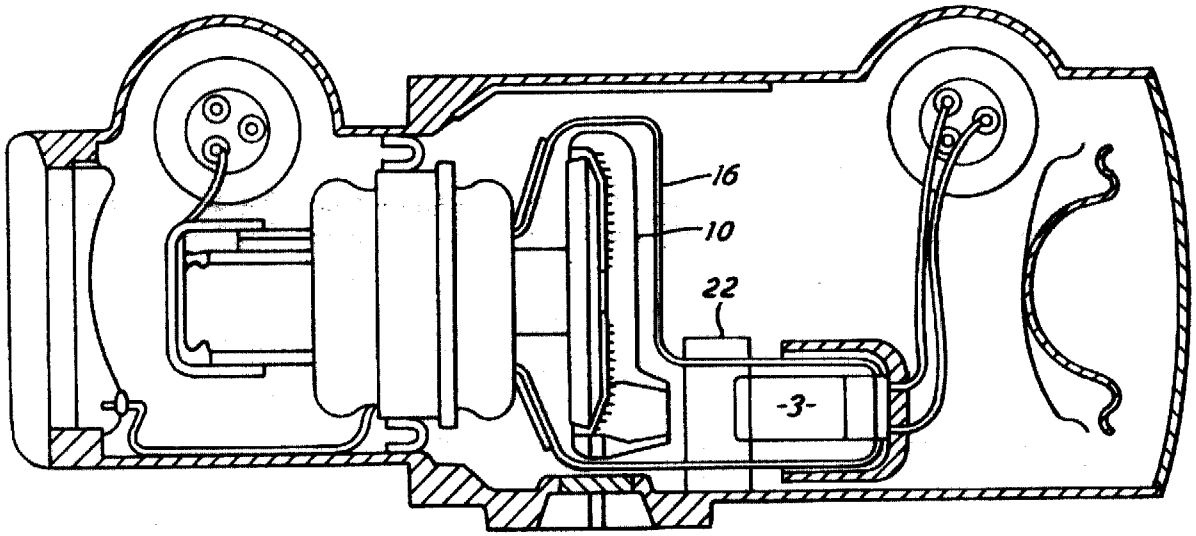
Figure 6:
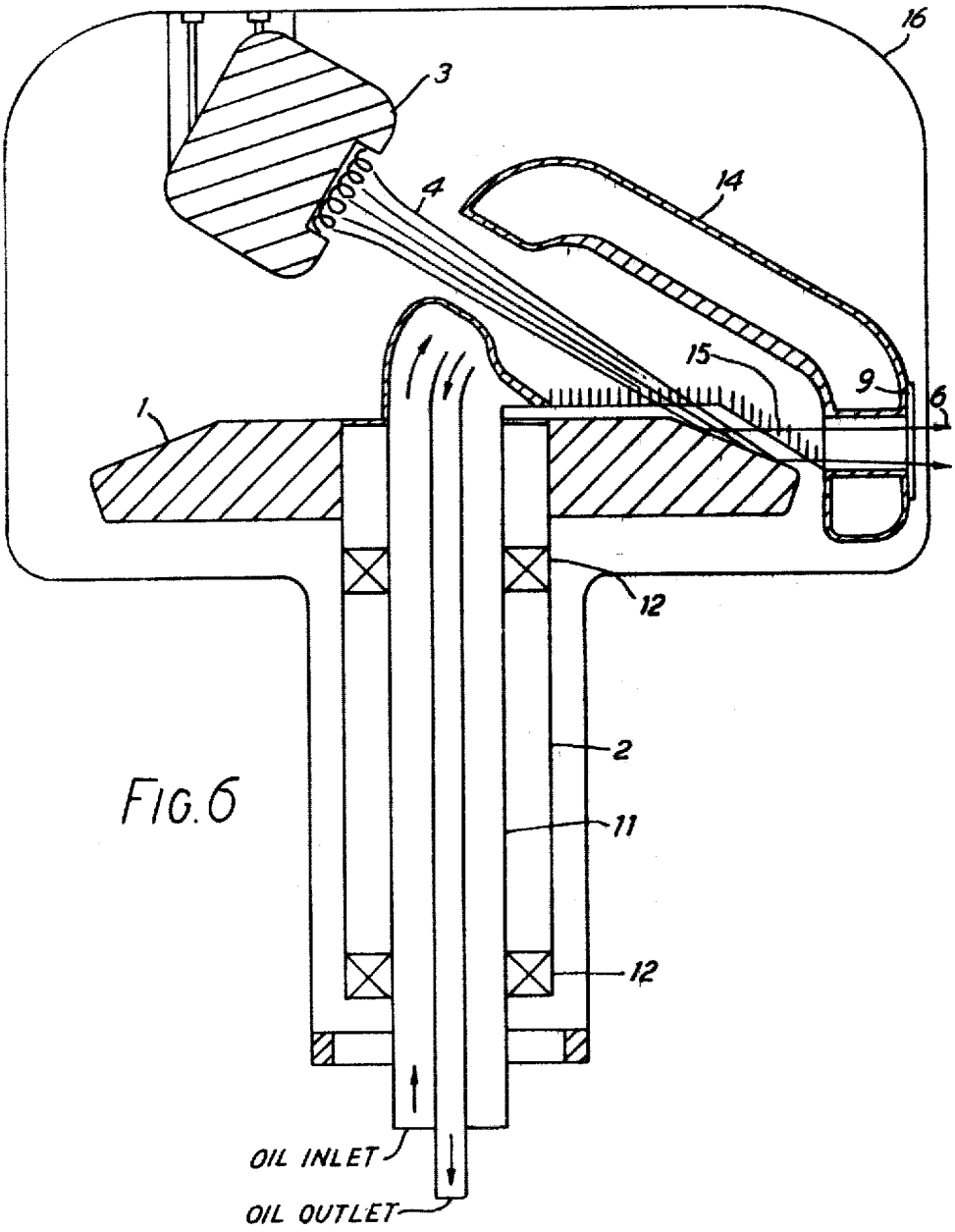
Figure 7A:
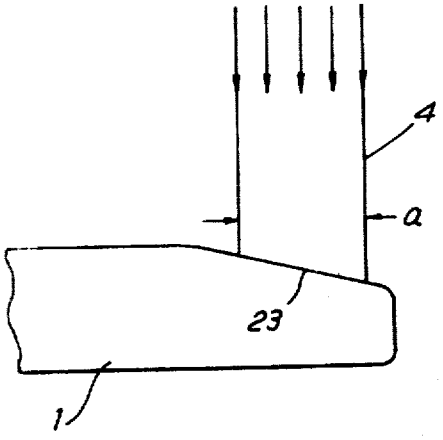
Figure 7B:
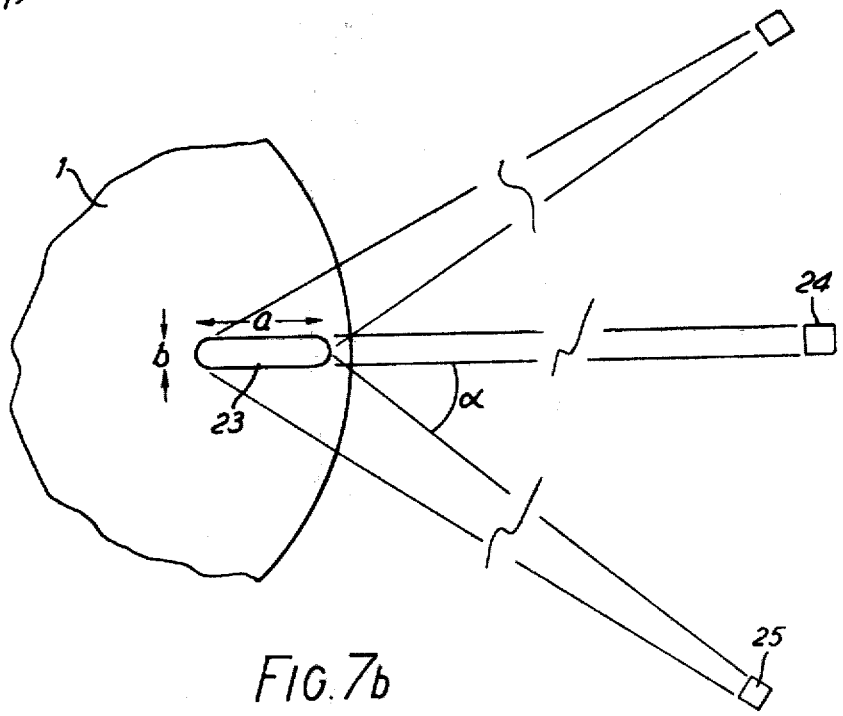
Figure 8:
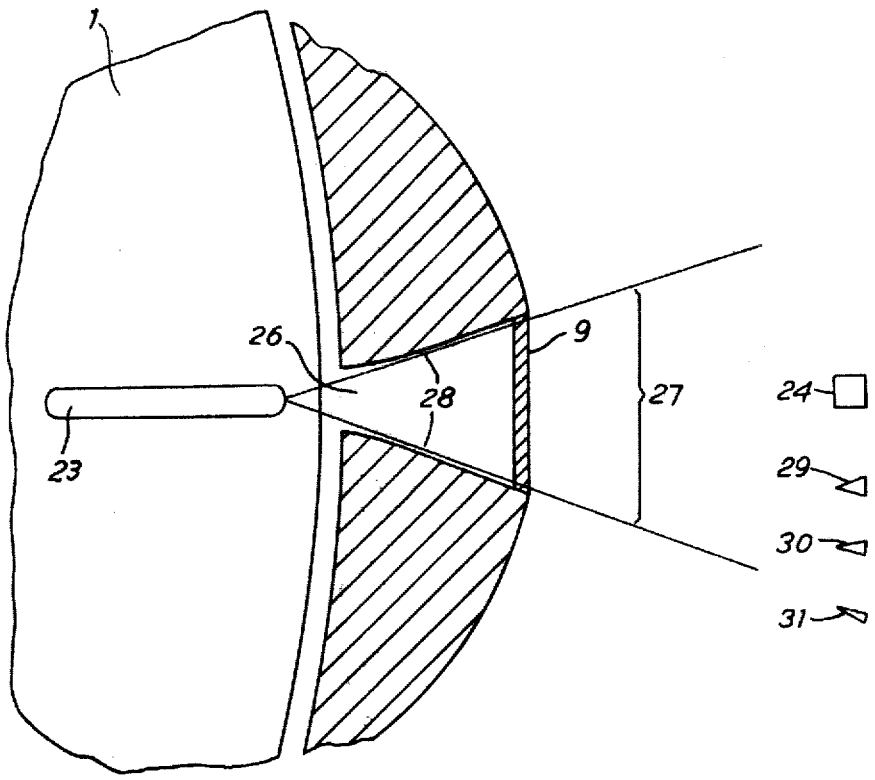

FIG. 3 shows a rotating anode x-ray tube incorporating an anode shroud in accordance with this invention, FIG. 4 shows the tube of FIG. 3 incorporated into a typical x-ray tube housing, FIG. 5 shows an alternative envelope and cathode arrangement for the x-ray tube of FIG. 4, FIG. 6 shows an alternative arrangement to FIG. 3 in which the electron beam is incident on the anode at a different angle, FIGS. 7*a* and 7*b* show the anode in elevation and plan, illustrating the effect of a ribbon-shaped electron beam and FIG. 8 shows a shape of collinating aperture in the shroud, having a beneficial effect on a wide angle X-ray beam.

Figure 1:
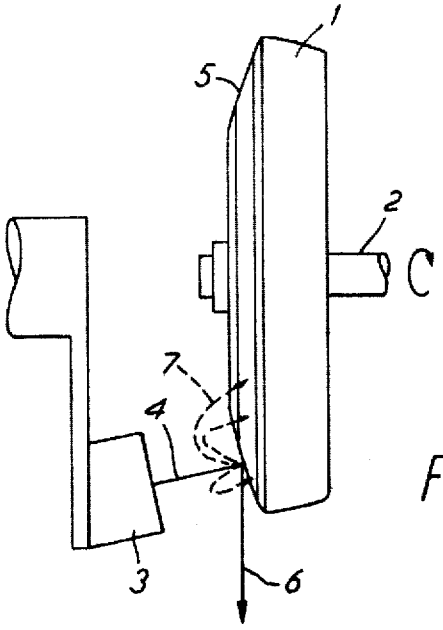
FIG. 1 PRIOR ART
FIG. 1 shows a prior art rotating anode x-ray tube.

A simplified diagram of a basic rotating anode x-ray tube is shown in FIG. 1. A disc shaped anode member 1 is mounted on a shaft 2 for rotation about its axis by suitable means allowing drive from outside the vacuum envelope (not shown). An electron gun 3 provides a beam 4 of electrons to be incident on anode 1 at a target track 5 from which x-rays 6 are generated. In operation shaft 2 and anode 1 are rotated so that the fixed beam 4 is incident on different regions of target 5, although always at the same point in space. Many of the incident electrons of beam 4 are reflected as back scattered electrons 7 which are also incident on the anode 1 and produce further x-rays which form the aforementioned halo of off-focus radiation.

Figure 2:
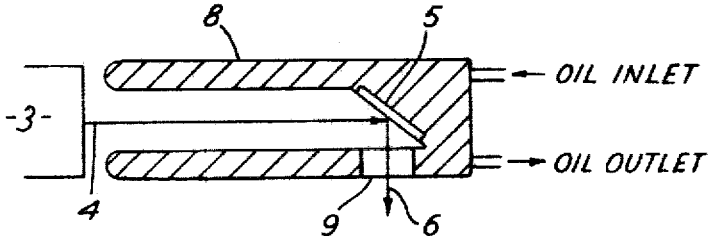
FIG. 2 PRIOR ART
FIG. 2 shows a prior art fixed anode x-ray tube.

It should be understood that the generation of back-scattered electrons is not peculiar to rotating anode x-ray tubes. However fixed anode x-ray tubes generally have a shroud, extending the anode/target, which collects the secondary electrons and which has a limited window of x-ray emissive material. This window serves to allow exit of the main x-rays while restricting exit of those of the halo. FIG. 2 shows the relevant features of a fixed anode x-ray tube, similar features to FIG. 1 being denoted by the same reference numerals. The shroud is shown at 8 and the x-ray emissive window therein is shown at 9.

Although this solution has been shown to restrict off-focus radiation it is not possible in rotating anode tubes to extend the anode into a shroud in the same manner in view of the constraint imposed by the rotation. It has been the practice in all commercial tubes to leave the anode relatively open and to rely on collimation to restrict the x-ray field.

FIG. 3 shows a rotating anode x-ray tube incorporating the improvements provided by this invention. In addition to those features conventionally found in rotating anode tubes, a fixed cover 10 is provided over the face of the anode 1. The shaft 2 is made hollow and encloses a further shaft 11 which supports cover 10. Shaft 2 is in fact arranged to rotate about further shaft 11 on bearings 12. Shaft 11 also includes oil passages 13 which allow cooling oil or other fluid to flow through cover 10. At one side, the anode cover 10 supports a shroud 14 which is symmetrically located about the spot at which the electron beam 4 from gun (cathode) 3 is incident on the anode 1. This is similar to the shroud known for fixed anode tubes and is shaped to provide x-ray collimation immediately adjacent the x-ray source spot, permitting more accurate shaping of the emergent X-ray beam than is obtainable when collimation is external to the tube envelope. A window 9, of beryllium or other suitable material, is provided to allow exit of the x-rays while stopping scattered electrons and also provides some filtration of the x-ray beam 6.

Cover 10 and shroud 14, the former in reality an extension of the latter, are, in this example, hollow, allowing the cooling oil to pass therethrough. The surface of cover 10 facing anode 1 is provided with fine ring shaped "black-body" grooves 15 which reduce the reflection of radiation from the anode and improve the ability of the oil cooled cover to remove heat from the anode. If desired it is possible for such grooves to be included on the inside surface of shroud 14.

The shroud 14 is at the same potential as the anode and collects the majority of the secondary electrons 7 thus contributing to anode cooling and ensuring that any x-rays created thereby are likely to be excluded by the collimating effect of the x-ray exit aperture.

As a further advantage it will be apparent that the cooling oil passing through shaft 11 (and arranged with the coolest oil on the outside) will tend to cool the anode bearings 12 and thereby prolong their life.

The rotor tube 2 is of larger diameter than is usual for rotating anode shafts but the effect of this is to provide added shaft stiffness and to reduce gyroscopic oscillations thereof.

The arrangement shown in FIG. 3 is designed to minimise departures from conventional practice with rotating anode x-ray tubes. It may be varied without departing from the principles of the invention. Anode-to-cathode spacing is greater than is the usual practice and the wide part of the tube envelope is larger than normal, both to the extent necessary to accommodate shroud 14. However the increased spacing also improves the hold-off capability of the tube and reduces the incidence of arcing.

FIG. 4 shows such a tube mounted in an envelope 16 and then incorporated in a typical tube housing 17. In general the housing and other components are typical of x-ray tubes and will not be discussed in detail.

One noteworthy feature is the provision of spider mounts 18 which support the stator windings 19 and provide tube centering. The stator leads 20 are rerouted in comparison with usual practice to increase spacing to the anode and an insulating cap 21 is provided to improve breakdown ratings.

Although it is not considered to be a serious problem, it should be noted that the design shown produces an assymetrical ground plane in the gap between anode and cathode. This does increase the difficulty of focussing the electron beam, in view of the larger gap and reduced accelerating gradient. If desired the tube can be made with an offset cathode and envelope, as shown in FIG. 5. Although this design is more difficult to manufacture, it does reduce envelope weight and simplify the cathode structure. It also permits the use of a field equalizing ring 22, at ground potential, around the anode-cathode gap.

A further alternative arrangement is shown in simplified form in FIG. 6. In this tube the electron gun or cathode 3 is arranged so that the electron beam 4 impinges on the target surface of anode, at an angle of about 30° to the x-ray beam. This geometry is known for x-ray tubes to be advantageous in certain circumstances. It can be readily incorporated in an x-ray tube using the present invention, as shown. In this example the shroud 14 covers a major part of the anode 1 and is not extended to provide additional cover over the remaining part of the anode. It may, however, be so extended if desired.

Other arrangements of a rotating anode x-ray tube in accordance with this invention, may readily be devised. For example the shroud or the anode cover or both need not be supported along the anode axis, as shown, but may be supported independently of the anode.

The shroud of this invention also lends itself to solution of a further problem. In X-ray tubes, including rotating anode X-ray tubes, it is common to use an electron beam of a ribbon shape as is shown in FIGS. *7a* and *7b* which are respectively elevational and plan views of part of a rotating anode. The electron beam 4 is wide in a direction a and narrow in a direction b to form a long thin focal spot 23. The principal direction of X-ray emission is conventionally considered to be radial to the anode and when viewed from that direction the focal spot is foreshortened to a small basically square shape giving an X-ray beam cross section as shown at 24. This allows a higher intensity of X-rays received in a square cross-section beam than a similarly square faced spot would permit.

However in, for example, computerised tomographic X-ray apparatus it is usual to view the X-ray spot over a wider angle so that the X-ray forms a fan substantially planar in the plane of FIG. *7b*. If the angle is small the focal spot may still be effectively foreshortened. In some applications, for example the 7070 scanner of EMI-Medical Inc., the angle is about 60° or even may be large as 90° and the focal spot, as viewed from 25, is not adequately foreshortened. This means that a X-ray detector at 25 will see a long dimension of the focal spot giving a wider X-ray beam cross-section. In CT apparatus this can degrade resolution to the edges of the patient's body.

It is proposed in X-ray tubes such as that described hereinbefore, in which the tube exit collimation is close to the focal spot, to shape the collimating aperture in a curve to successively shadow more of the anode as the angle $\alpha$ in between the viewing position and the in-line position increases.

The arrangement is shown in FIG. 8 in which X-ray emitted from the focal spot 23 pass through aperture 26 in the shroud 14 (and through beryllium exit window 9) to form a fan 27 of X-rays suitable for use in CT. The sides 28 of the aperture 26 are slightly curved so that the focal spot 23 has the apparent shapes shown from the square shape 24 at the centre, through 29 and 30 to the narrow shape shown at 31 for the edge of the fan. It will be appreciated that there is a consequential reduction in X-ray intensity, towards the edges of the fan, of 20–100 depending on the precision of the focal spot location (a final adjustment of the relative location of the aperture 26 and the focal spot 23 is desirable to provide a symmetrical intensity distribution across the fan). The intensities relative to 24 as unity are therefore typically 0.5 at 29, 0.25 at 30, and 0.02 at 31.

This is, however, convenient for use in CT systems. As mentioned the X-rays at the extremes of the fan 27 tend to pass through the edge of the patient and having shorter absorbing paths through the patient, are often deliberately attenuated to reduce the necessary dynamic range of detectors. This is often achieved by using a wedge-shaped attenuator, often of aluminum, inserted into the radiation with its thinnest part at the centre of the fan. Examples are shown in U.S. Pat. Nos. 3,937,963 and 3,946,234. The edge attenuation imposed by this collimator shape may assist or even replace such a 'wedge' attenuator.

It will be understood that this collimater arrangement requires the collimator to be very close to the anode so that mechanical tolerances can be maintained within reasonable limits. It is suitable for any X-ray tube for which that consideration applies.

What I claim is:

1. A rotating anode X-ray tube including an envelope and, mounted within the envelope: an anode adapted for rotation about an axis thereof, an electron gun arranged to direct a beam of electrons to be incident on the surface of the anode to generate X-rays therefrom and a shroud member, fixed relative to said electron gun, arranged closely to enclose said electron beam immediately adjacent its region of incidence on the anode, to collect secondary electrons emitted from the region of incidence in response to said incident beam without impeding rotation of said anode, said shroud member including an X-ray transmissive window.

2. A rotating anode x-ray tube according to claim 1 in which the shroud is extended from said region to provide a cover closely adjacent to the surface of said anode to facilitate the cooling thereof.

3. A rotating anode x-ray tube according to either claim 1 or claim 2 in which means are provided for directing a flow of cooling fluid through said shroud.

4. A rotating anode x-ray tube according to either claim 1 or claim 2 in which the surface of the shroud adjacent the surface of the anode is configured to reduce reflection of heat generated at the anode.

5. A rotating anode x-ray tube according to claim 4 in which the configuration comprises fine grooves in the said shroud surface.

6. A rotating anode x-ray tube according to claim 5 in which the grooves are in the form of concentric rings or part rings concentric with the axis of said anode.

7. A rotating anode x-ray tube according to claim 1 in which the shroud member is supported on a support member disposed along the anode axis and in which there are provided bearings about said member on which the anode is arranged to rotate.

8. A rotating anode x-ray tube according to claim 7 including conduits passing through said support member for transferring cooling fluid to and from said shroud.

9. A rotating anode X-ray tube including an envelope and, mounted within the envelope: an anode mounted for rotation, an electron gun arranged to direct an electron beam to be incident on the surface of said anode to generate X-rays therefrom and a generally cylindrical shroud member arranged closely to enclose said electron beam at the anode surface to shield other parts of the anode surface from secondary electrons emitted at the region of incidence of the electron beam, said shroud including a window of X-ray transmissive material.

10. A rotating anode X-ray tube including an envelope and, mounted therein: an anode mounted for rotation about an axis thereof; an electron gun arranged to direct a beam of electrons to be incident on the surface of said anode at a region which moves over said surface in the course of said rotation; a cover, fixed relative to said electron gun, arranged to be closely adjacent to a substantial part of the surface of said anode on which the beam is incident and including an aperture by which the electron beam may reach said surface.

11. A rotating anode x-ray tube according to claim 10 in which the cover around said aperture is extended towards said electron gun to form a shroud substantially symmetrically disposed about said electron beam.

12. A rotating anode x-ray tube according to claim 11 including means adapted to facilitate the withdrawal of heat from the anode.

13. A rotating anode x-ray tube according to claim 12 in which the means adapted to facilitate the removal of heat include means for applying cooling fluid to said cover.

14. A rotating anode X-ray tube including an envelope and, mounted therein: a shaft member and a substantially disc-shaped anode member mounted thereon for rotation about an axis therethrough; a plurality of bearings co-operating with the shaft member on which the anode is mounted to facilitate rotation of the anode member about said axis therethrough; means for rotating the anode about said axis; an electron gun arranged to direct an electron beam at the surface of said anode such that the region of incidence of the electrons moves over said surface in the course of said rotation; a cover member fixed relative to the electron gun, arranged closely adjacent the surface of the anode on which the electron beam is incident to cover a major part thereof, said cover member having an aperture therein through which the electron beam can pass to be incident on the anode and being extended towards said electron gun at said aperture to form a shroud closely enclosing the electron beam as it approaches the anode, the cover and the shroud being effective to shield parts of said anode surface other than the region of incidence from secondary electrons emitted from said region of incidence in response to the incident electron beam; and an X-ray emissive window in said cover to allow the exit of X-rays generated at said anode by incidence of the electron beam.

15. A rotating anode x-ray tube including an anode adapted for rotation about an axis therethrough, an electron gun arranged to direct a beam of electrons to be incident on the surface of the anode at a region which moves thereover in the course of said rotation, a shroud member adapted to collect backscattered electrons produced at said anode by said incident beam and means by which x-rays, generated at said anode by said incident beam, may leave said tube.

16. A rotating anode X-ray tube according to either claim 1, claim 14 or claim 15 in which the shroud member includes a collimating aperture which allows exit of the X-rays in the form of a substantially planar fan shaped distribution, wherein the collimating aperture is formed with curved sides in the plane of the distribution to reduce the proportion, of the origin of the X-rays, viewed as the position of viewing moves from the centre to the edge of the fan.

17. An X-ray tube having an anode, an electron gun arranged to direct a beam of electrons to be incident on the surface of the anode at a region from which X-rays are generated, a shroud member closely surrounding said anode, at least immediately adjacent said region, a collimating aperture in said shroud at which the X-rays are allowed to exit and are constrained to a fan-shaped distribution, the sides of the aperture in the plane of the fan being curved to reduce the proportion of said X-ray emitting region viewed with increasing angle from the centre to the edge of the fan distribution.

18. An X-ray tube according to claim 17 wherein said anode is adapted to rotate about an axis therethrough and means are provided to cause rotation while said X-rays are being generated.

19. An X-ray tube having an envelope and, mounted in the envelope: an anode, an electron gun arranged to direct a beam of electrons to be incident on the surface of the anode at a region from which X-rays are generated, a shroud member closely surrounding said anode, at least immediately adjacent said region, a collimating aperture in said shroud at which the X-rays are allowed to exit and are constrained to a fan-shaped distribution, the sides of the aperture in the plane of the fan being shaped so as to reduce the intensity of the X-rays transmitted by the aperture with increasing angle from the centre line of the fan distribution.

20. A rotating anode X-ray tube including an envelope and, mounted therein: a substantially disc-shaped anode member, a shaft member on which the anode member is mounted for rotation about an axis therethrough, and a plurality of bearings co-operating with the shaft member about said axis; means for rotating the anode about said axis; an electron gun arranged to direct an electron beam at the surface of said anode such that the region of incidence of the electrons moves over said surface in the course of said rotation; a cover member fixed relative to the electron gun, arranged closely to cover a major part of the surface of the anode on which the electron beam is incident, said cover member having an aperture therein through which the electron beam can pass to be incident on the anode and being extended towards said electron gun at said aperture to form a shroud enclosing the electron beam as it approaches the anode; a collimating aperture having an X-ray emissive window in said cover to allow the exit of X-rays generated at said anode by incidence of the electron beam, the aperture being shaped to constrain the X-ray into a fan-shaped distribution and so that the proportion of the region of incidence contributing X-ray to any part of the fan is reduced with increasing angle from the centre line to the edge of the fan.

* * * * *